US005402934A

United States Patent [19]

Sauerwine

[11] Patent Number: 5,402,934

[45] Date of Patent: Apr. 4, 1995

[54] Z-FOLD MAILER WITH WINDOW AND RETURN ENVELOPE

[75] Inventor: Dean N. Sauerwine, Emmaus, Pa.

[73] Assignee: Moore Business Forms, Inc., Grand Island, N.Y.

[21] Appl. No.: 117,664

[22] Filed: Sep. 8, 1993

[51] Int. Cl.[6] ..... B65D 27/06

[52] U.S. Cl. ..... 229/303; 229/304; 229/314

[58] Field of Search ..... 229/303, 304, 314, 316

[56] References Cited

U.S. PATENT DOCUMENTS

| | | | |
|---|---|---|---|
| 2,669,464 | 2/1954 | Lay et al. . | |
| 3,126,148 | 3/1964 | Hanson . | |
| 3,152,800 | 10/1964 | Hanson . | |
| 3,184,150 | 5/1965 | Hubbard . | |
| 3,652,007 | 3/1972 | MacDougall . | |
| 3,701,468 | 10/1972 | Steinhauser . | |
| 3,977,597 | 8/1976 | Wise et al. . | |
| 4,055,294 | 10/1977 | Traise | 229/304 X |
| 4,706,878 | 11/1987 | Lubotta et al. . | |
| 4,715,530 | 12/1987 | Leese et al. | 229/303 |
| 4,715,531 | 12/1987 | Stewart et al. . | |
| 4,889,278 | 12/1989 | Steidinger . | |
| 4,896,823 | 1/1990 | Taylor . | |
| 4,928,875 | 5/1990 | Hutchinson . | |
| 5,174,493 | 12/1992 | File . | |
| 5,193,850 | 3/1993 | Lombardo . | |
| 5,201,464 | 4/1993 | File . | |
| 5,282,568 | 1/1994 | File | 229/304 |
| 5,289,972 | 1/1994 | Sauerwine et al. | 229/303 |

FOREIGN PATENT DOCUMENTS 128643 4/1984 European Pat. Off. .

*Primary Examiner*—Allan N. Shoap
*Assistant Examiner*—Jes F. Pascua
*Attorney, Agent, or Firm*—Nixon & Vanderhye

[57] ABSTRACT

An intermediate for a mailer type business form is formed from a quadrate sheet of paper which is Z-folded to produce a mailer type business form with a reply envelope. A large amount of area is provided for printing yet the reply envelope produced accepts a conventional size personal check without folding. The outgoing address is visible through a window and a first ply of the mailer, the outgoing address printed on the second ply of the mailer. The second and third plies of the mailer have a first perforation line which allows separation into a reply envelope and coupons or stubs, at least one of which can be returned to the entity sending out the outgoing mailer, and the reply address for the return envelope is printed on the top face of the second, middle, ply of the mailer.

20 Claims, 4 Drawing Sheets

Z-FOLD MAILER WITH WINDOW AND RETURN ENVELOPE

BACKGROUND AND SUMMARY OF THE INVENTION

Mailer type business forms must serve a wide variety of customer requirements. Depending upon particular needs, mailer type business forms must be specifically tailored to provide an acceptable product. Two features that are almost universally desirable, however, are the ability to print on a large amount of the mailer, yet still have a reply envelope. Even more desirable is the ability to have a reply envelope that accepts a conventional size (i.e. six inch length) personal check without folding, and having a reply envelope flap that will fold to the back of the reply envelope, and to have a remittance coupon or stub portion which includes the outgoing addressee's address so that it may easily be detached and inserted in the reply envelope for return along with the check.

According to the present invention, an intermediate for a mailer type business form, and the mailer itself, are provided which achieve the objectives set forth above. The intermediate comprises a single quadrate sheet of paper which may be easily run through a printer to print indicia on either one or both faces, with the same face having the outgoing address and reply address printed thereon so that they may be readily variably printed. The intermediate may be easily Z-folded to form the final mailer, and sealed by conventional techniques. The mailer is easy to open and the reply envelope is easy to utilize.

According to one aspect of the present invention an intermediate for a mailer type business form comprises the following components: A quadrate sheet of paper having parallel top and bottom edges, parallel first and second side edges perpendicular to the top and bottom edges, and first and second faces. First and second fold lines parallel to the top and bottom edges, and defining the sheet into substantially equal-size first, second, and third panels, the first panel between the top edge and first fold line, and the second panel between the first and third panels. Means defining a cutout window in the first panel adjacent the second edge and the first fold line. Means defining an outgoing address area on the second face of the second panel aligned with the window so that when the first and second panels are folded about the first fold line so that the second faces thereof are in face-to-face engagement, the outgoing address area is visible through the window. Means defining an outgoing return address area on the first face of the first panel adjacent the first and top edges of the sheet. A first line of weakness extending through the second and third panels parallel to the side edges defining first and second subpanels in each, the first subpanel in each being defined by the first side edge and the first line of weakness and the second subpanel in each being defined by the first line of weakness and the second side edge, the second panel second subpanel second face having the outgoing address area thereon. Means defining a reply address area on the second face of the second panel first subpanel. First permanent adhesive patterns provided on at least one of the second and third panel first subpanel first faces for defining the second and third panel first subpanels into a reply envelope having permanent adhesive on first through third sides thereof when the second and third panels are folded about the second fold line so that the first faces thereof are in face-to-face engagement. A reply envelope closing flap formed in one of the second and third panel first subpanels and having activatable adhesive thereon for sealing a reply envelope on a fourth side thereof. Second, third, fourth, fifth and sixth lines of weakness formed in the first, second and third panels parallel to the top and bottom edges, and first through third panels parallel to and spaced from each of the first and second side edges, defining tear-off strips providing for ready opening of a mailer constructed by Z-folding the sheet about the fold lines. And, second permanent adhesive patterns provided in at least some of the tear-off strips for holding the first through third panels together in an outgoing mailer when the sheet is Z-folded about the fold lines.

The first line of weakness preferably does not extend into the first panel of the intermediate, and does not intersect the window. The reply envelope may be constructed so that it is either of the side opening or top opening type. Typically the reply envelope flap extends parallel to the first and second side edges, and is bordered by the first line of weakness, to construct a side opening envelope, and the reply envelope flap extends parallel to the top and bottom edges, and is bordered by the third line of weakness, when forming the top opening envelope. In either case the reply envelope flap is preferably formed in the second panel and the first permanent adhesive patterns are heat or pressure seal adhesive strips provided on the third panel first face. The longest dimension of the interior of the reply envelope formed from the intermediate is at least about six inches so that the reply envelope can receive an unfolded bank check within it.

The second permanent adhesive patterns may comprise a strip of heat seal adhesive provided on the third panel second subpanel first face adjacent the bottom edge, for sealing the second and third panel second subpanels together along one edge thereof when the sheet is Z-folded about the second fold line; or the second and third panels second subpanels may be devoid of adhesive extending parallel to the top and bottom edges so that a space between the second and third panels second subpanels is always accessible from the bottom edge.

Typically the folding lines will be lines of weakness, such as perforation lines, and the activatable adhesive is rewettable adhesive, and the permanent adhesive is either heat seal or pressure seal adhesive. Security screening is preferably provided on the first face of the second and third panel first subpanels so that the reply envelope is opaque.

According to another aspect of the present invention a mailer type business form is provided comprising the following elements: First, second, and third substantially equal size quadrate plies, the second ply sandwiched between the first and third plies, and each ply having a top face and a bottom face. Lines of weakness formed in the second and third plies defining the second and third plies into first and second subplies, the first subplies larger than the second subplies. A window in the first ply overlying the second subply of the second panel. An outgoing address provided on the second ply second subply top face, aligned with and visible through the window. An outgoing return address provided on the first ply top face remote from the window, and overlying the first subplies of the second and third plies. A reply address provided on the top face of the second ply first subply. First permanent adhesive patterns acting between the second ply first subply top face and the third ply first subply top face for holding the second and third ply first subplies together along first through third edges of each to form a reply envelope. A reply envelope flap formed in one of the second and third plies first subply along a fourth edge of a reply envelope, and including activatable adhesive on a face thereof which is interior of the mailer. Additional lines of weakness formed adjacent edges of the first through third plies to define tear-off strips for providing ready opening of the mailer. And, second permanent adhesive patterns provided on the tear-off strips for holding the first through third plies together to form the mailer until the tear-off strips are removed.

The mailer has the features described above with respect to the intermediate when the intermediate is Z-folded to produce the mailer, and is fed through a heat seal or pressure seal conventional piece of equipment to seal the first and second permanent adhesive patterns. Also indicia is preferably provided substantially completely covering the first ply bottom face, the bottom face of the second ply second subply, and the top face of the third ply second subply. Indicia also may be provided on the bottom face of the third panel (return envelope and coupon portion), although that indicia would have to be non-personal indicia; and other indicia besides the outgoing address may be printed on the top face of the second ply second subply.

It is the primary object of the present invention to provide an intermediate for a mailer, and a mailer, with a great deal of printable area or indicia, as well as a reply envelope, that is readily constructed and utilized. This and other objects of the invention will become clear from an inspection of the detailed description of the invention, and from the appended claims.

DETAILED DESCRIPTION OF THE DRAWINGS

Figure 1:
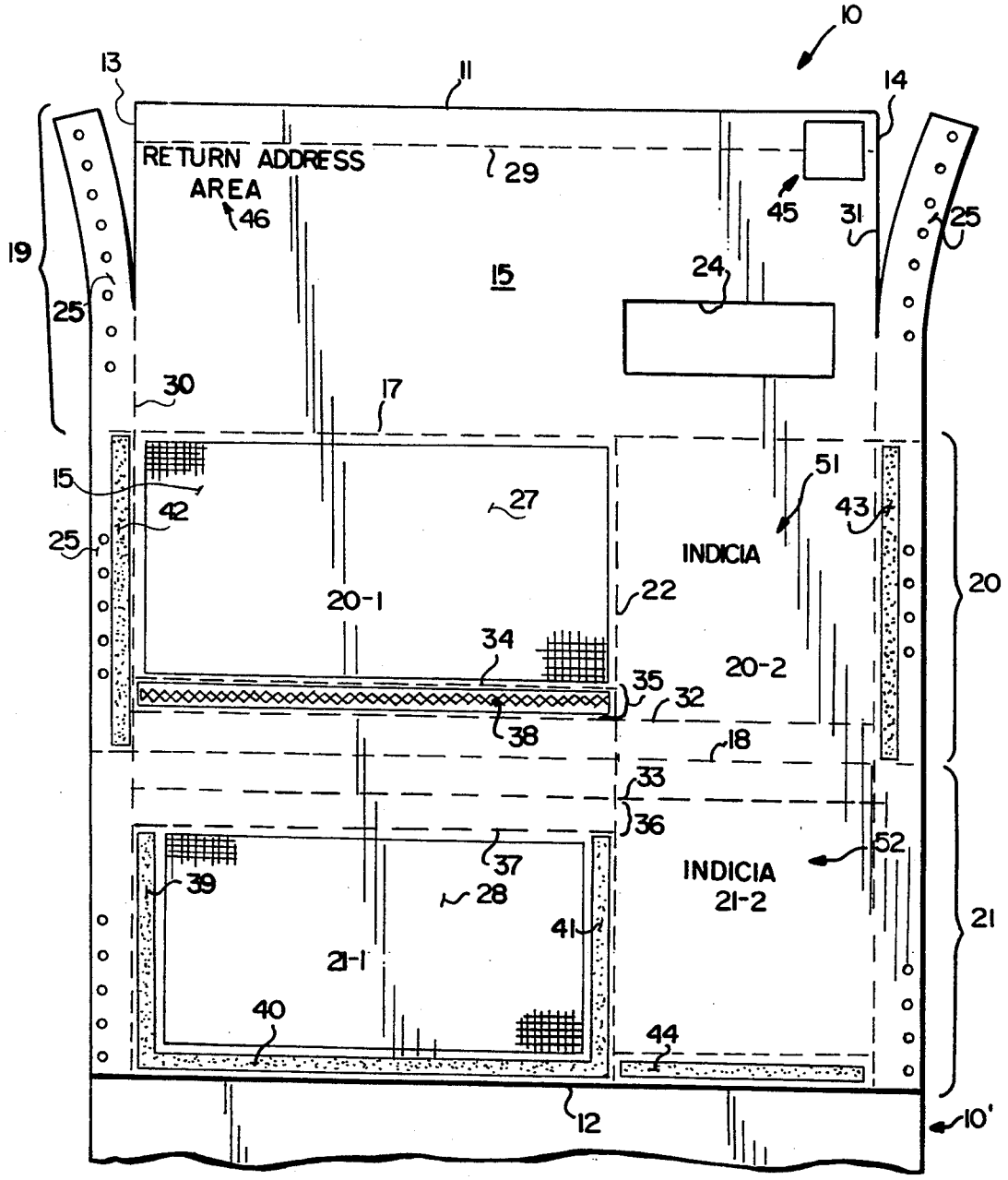
FIG. 1 is a top plan view of a first face of an exemplary intermediate according to the present invention.
Figure 2:
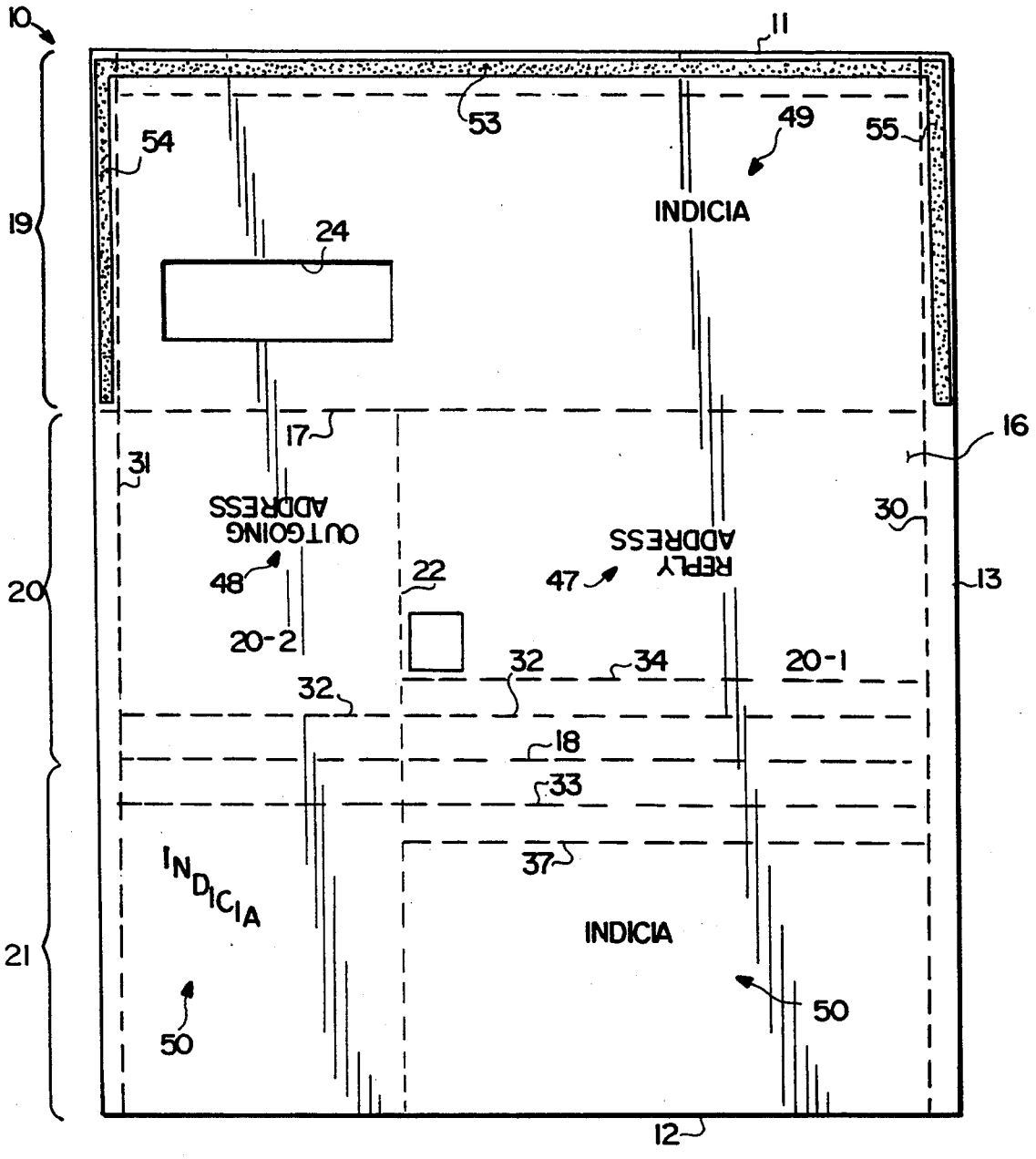
FIG. 2 is a plan view of the second face of the intermediate of FIG. 1.

An exemplary intermediate for a mailer type business form is shown generally by reference numeral 10 in FIGS. 1 and 2. It includes a quadrate sheet of paper having parallel top and bottom edges 11, 12, and parallel first and second side edges 13, 14, respectively. The side edges 13, 14 are perpendicular to the top and bottom edges 11, 12. The sheet also includes first and second faces 15 (FIG. 1) and 16 (FIG. 2), respectively.

First and second fold lines 17, 18 are provided parallel to the top and bottom edges 11, 12 defining the sheet of the intermediate 10 into three substantially equal-sized panels, first panel 19, second panel 20, and third panel 21. The first panel 19 is between the top edge 11 and the first fold line 17, while the second panel 20 is between the first and third panels 19, 21 (that is between the fold lines 17, 18).

A first line of weakness, shown as a perforation line 22 in FIGS. 1 and 2, extends through the second and third panels 20, 21 parallel to the side edges 13, 14 and defines the panels 20, 21 into first and second subpanels. The first subpanel of second panel 20 is illustrated by reference designation 20-1, while the second subpanel is indicated by reference designation 20-2. For the third panel 21, the first subpanel is designated by reference 21-1 while the second subpanel is indicated by designation 21-2, the second subpanels being adjacent the second side edge 14, while the first subpanels 20-1, 21-1 are adjacent the first side edge 13.

The intermediate 10 also comprises means defining a cutout window 24 in the first panel 19 adjacent the second edge 14 and the first fold line 17—that is near the lower right hand corner of the first panel 19 as viewed in FIG. 1. The first perforation line 22 preferably does not extend into the first panel 19, and does not intersect the window 24, although it may be substantially aligned with the leftmost edge of the window 24 as viewed in FIG. 1.

As see in FIG. 1, detachable tractor drive strips 25 may be provided for the intermediate 10 during processing. These drive strips 25 are conventional and facilitate handling of the intermediate 10 for printing or the like during manufacture of a mailer. The strips 25 are particularly desirable when the intermediate 10 is in continuous form, that is when the top and bottom edges 11, 12 thereof are really lines of weakness between the intermediate 10 and like intermediates, such as the intermediate 10' shown schematically in FIG. 1. During normal processing, the strips 25 are slit off at an appropriate stage, exposing the edges 13, 14, although if desired the strips 25 may be maintained in the final mailer.

If it is desired to provide a substantially opaque reply envelope when the intermediate 10 is constructed into a mailer, it is desirable to provide screen printing, as indicated at 27 and 28 in FIG. 1, to the subpanels 20-1 and 21-1. The screen printing is provided by any conventional technique typically prior to the time that the intermediate 10 is transported to the entity that will be printing the variable information on the intermediate 10 (that is the outgoing and reply addresses, etc.).

The intermediate 10 also comprises other lines of weakness, such as perforation lines, besides the first line of weakness 22. As illustrated in FIGS. 1 and 2, preferably a second line of weakness 29 is provided parallel to edge 11 and substantially immediately adjacent to it, third and fourth lines of weakness 30, 31 are provided parallel to and adjacent the edges 13, 14, fifth and sixth lines of weakness 32, 33 are provided parallel to the edges 11, 12 and straddling the second fold line 18, and another line of weakness or fold line 34 is provided in subpanel 20-1, defining a reply envelope flap 35 between it, the perforation line 32, and the perforation lines 30, 22, as seen in FIG. 1. A removable stub or flap 36 also is defined between the perforation lines 33, 37, 30 and 22 as also seen in FIG. 1, the removal of the stub 36 exposing the activatable adhesive pattern 38 (e.g. a rewettable continuous glue strip) provided on the first face 15 of the flap 35. Also, preferably the first and second fold lines 17, 18 are lines of weakness, such as perforation lines.

The intermediate 10 also comprises first permanent adhesive patterns, such as the continuous heat seal adhesive strips 39 through 41 illustrated in FIG. 1, which define first through third edges of a reply envelope that is constructed from the intermediate 10. The fold over, rewettable-glue containing reply envelope flap 35 defines the fourth edge of the reply envelope. While heat seal adhesive is desirable for the patterns 39 through 41, pressure seal adhesive also can be utilized, in which case typically patterns comparable to the patterns 39 through 41 would be provided on the face 15 of subpanel 20-1 so that the adhesive strips cooperated when the intermediate 10 is Z-folded about the fold line 18.

Second permanent adhesive patterns also are provided associated with the mailer 10. The second permanent adhesive patterns, which typically are continuous strips of heat or pressure activated adhesive, are provided in the tear off strips defined by the perforation lines 29 through 33, which allow ready opening of a mailer formed form the intermediate 10. Typical desirable locations for such strips are indicated at 42 through 44 in FIG. 1. Other strips 53 through 55 are seen in FIG. 2 provided along the edges 11, 13, 14 of the first panel 19. If desired, in order to allow ready detachment of the subpanel 21-2, a perforation line 44' may be provided just above the strip 44 in FIG. 1.

The intermediate 10 also comprises a wide variety of indicia. This includes the outgoing return address indicia 46 either non-variably or variably printed on the first face 15 of the first panel 19 at the corner thereof where the edges 11, 13 intersect. Reply address indicia 47 (see FIG. 2) for the return envelope is printed on the second face 16 in the subpanel 20-1 so that it is "upside down? if the edge 11 is the top edge. Outgoing address indicia 48 is printed on panel 20-2, second face 16, also "upside down? with respect to top edge 11 as illustrated in FIG. 2, the outgoing address indicia 48, provided in an outgoing address area, being visible through the window 24 when the intermediate 10 is Z-folded about the fold lines 17, 18 so that the faces 16 of the panels 19, 20 come into face-to-face engagement with each other. Typically the indicia 47, 48 is variably printed.

The intermediate 10 comprises a large amount of area for indicia. For example the indicia 49 may be provided on essentially the entire second face 16 of the first panel 19, either upside down or right side up with respect to the top edge 11. The indicia 50 may be provided on second face 16 of both subpanels of the third panel 21 as illustrated in FIG. 2, although the indicia 50 would have to be non-confidential indicia since it will be on the outside of the outgoing mailer and, for that indicia on subpanel 21-1 on the outside of the reply envelope too. The indicia 51 is provided on the first face 15 of the subpanel 20-2, while the indicia 52 is provided on the first face 15 of the subpanel 21-2.

Figure 3:
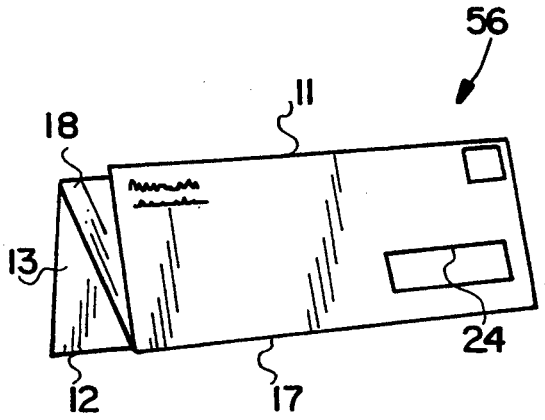
FIG. 3 is a top perspective view showing the intermediate of FIGS. 1 and 2 being folded into a mailer type business form.
Figure 4:
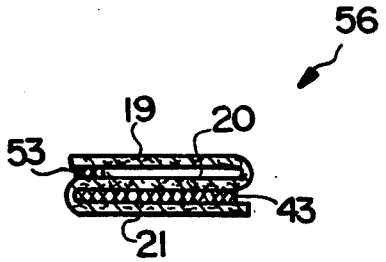
FIG. 4 is a side cross-sectional view of the mailer of FIG. 3.
Figure 5:
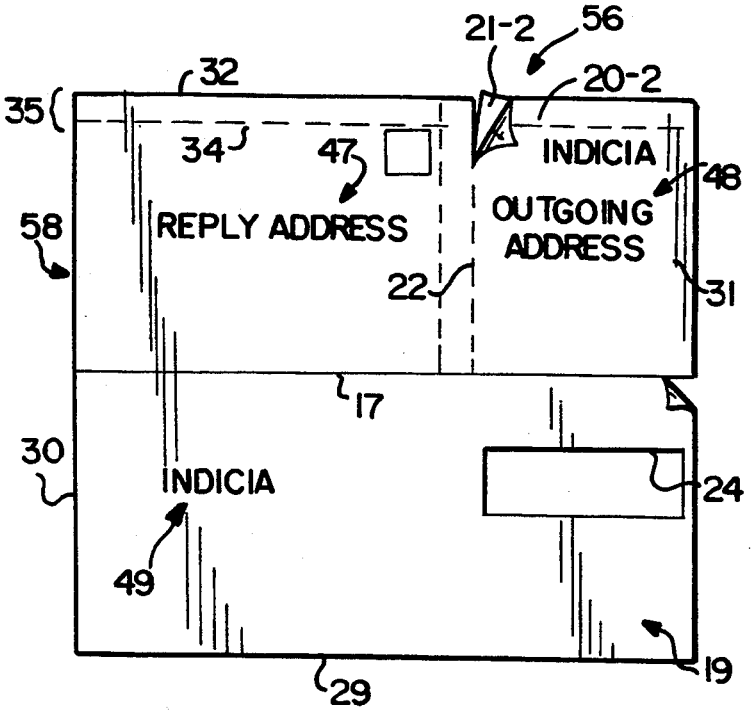
FIG. 5 is a top plan view of the mailer of FIGS. 3 and 4 once it has been opened up, and indicating initiation of detachment of the remittance coupon and other components from the reply envelope.

When constructing the mailer 56—seen in FIGS. 3 through 5—from the intermediate 10, after all of the indicia, at least the indicia 47, 48 being variable, 46 through 52 are printed on the intermediate 10, and after the intermediate 10 is detached from any other like intermediates (such as intermediate 10') if in continuous form, the intermediate 10 is Z-folded about the lines 17, 18 as illustrated in FIG. 3. It is then run through either a heat or pressure adhesive activating machine to seal the panels 19-21 thereof together by activating the adhesive in strips 39-44 and 53-55. This also simultaneously forms the return envelope, seen at 58 in FIG. 5.

When the outgoing addressee receives the mailer 56, he/she opens it up by tearing along the perforation lines 29-31 visible on the first ply 19, which simultaneously also detaches the perforation lines 30-33 associated with the second ply 20 and third ply 21 (see FIG. 4). After removing the tear off strips by tearing along these perforation lines, the mailer 56 can be opened up by folding of the first ply 19 about the fold line 17 as indicated in FIG. 5, exposing the reply envelope 58, including the reply address 47. By tearing along the first perforation line 22, which separates both coupon or stub portion 20-2, 21-2 from the reply envelope 58, and by tearing along fold/perforation line 17, the reply envelope 58 is separated along with the coupon 20-2 containing the outgoing address 48. Then the coupon 20-2, along with a conventional bank check (e.g. six inches in size), is inserted into the open top of the reply envelope 58, the flap 35 is folded down about the fold line 34 (after detachment of the stub 36) so that the activatable adhesive 38 comes in contact with the bottom face of the third ply 21, and the reply envelope 58 is mailed back to the reply addressee. Note that in the configuration of FIG. 5 the indicia 49 is readily visible.

The intermediate 10 typically will have a length (edges 13, 14) of about 12–14 inches, and a width (the length of edges 11, 12) of about 10.5–12.5 inches, in order to be able to accommodate a conventional six inch long bank check without folding of the check, in a reply envelope 58, although other sizes may be provided if it is not desirable or necessary to have a reply envelope 58 of that size.

Figure 6:
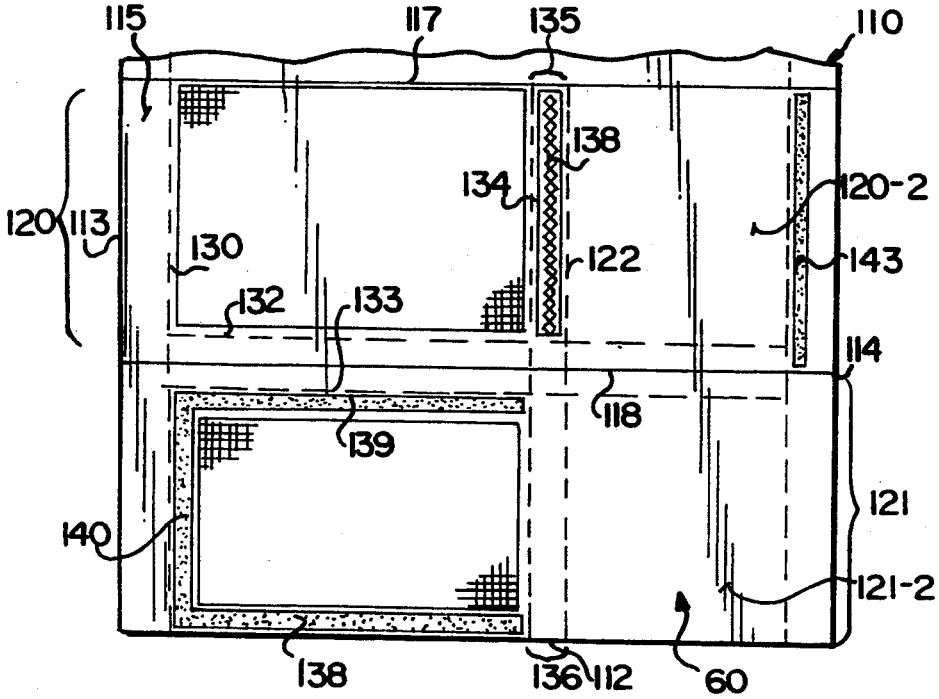
FIG. 6 is a view like that of FIG. 1 showing a second embodiment of the second and third panels of a business form intermediate, used for making a side opening reply envelope rather than a top opening reply envelope.

FIG. 6 illustrates a second embodiment of intermediate 110 according to the present invention. In the FIG. 6 embodiment elements comparable to those in the FIGS. 1 through 5 embodiment are shown by the same two digit reference numeral preceded by a "1", and therefore the exact nature of all of the elements indicated by reference numerals in FIG. 6 will not be described.

The only significant differences between the intermediates 10, 110 is in the construction of the reply envelope, and the location or lack of a particular adhesive strip. In the FIG. 6 embodiment, the permanent adhesive patterns 138–140 forming the reply envelope are disposed as illustrated in FIG. 6 along three edges of the reply envelope, to construct a side-opening reply envelope. The return envelope flap 135 is formed in the second panel 120, between the perforation lines 122, 134 with the activatable (e.g. rewettable) adhesive pattern 138 provided on the face 115.

In the FIG. 6 embodiment, the permanent adhesive strip 44 from the FIG. 1 embodiment is not provided, but rather the area 60 is devoid of adhesive, so that the subpanels 120-2, 121-2 may be accessed from the bottom edge 112 (between the bottom edge 112 and the fold line 118) when the intermediate 110 is Z-folded about the fold lines 117, 118, to bring the faces 115 of the panels 120, 121 into face-to-face contact with each other.

It will thus be seen that according to the present invention a simple and easy to construct, print, and utilize mailer has been provided, having a large amount of printable area, and a reply envelope, which preferably can accept a six inch personal check without folding. The return envelope flap also folds to the back of the reply envelope, as is most desirable for ease of use and aesthetics. While the invention has been herein shown and described in what is presently conceived to be the most practical and preferred embodiment it will be apparent to those of ordinary skill in the art that many modifications may be made thereof within the scope of the present invention, which scope is to be accorded the broadest interpretation of the appended claims so as to encompass all equivalent intermediates and business forms.

What is claimed is:

1. An intermediate for a mailer type business form, comprising:

a quadrate sheet of paper having parallel top and bottom edges, parallel first and second side edges perpendicular to the top and bottom edges, and first and second faces;

first and second fold lines parallel to said top and bottom edges, and defining said sheet into substantially equal-size first, second, and third panels, said first panel between said top edge and first fold line, and said second panel between said first and third panels;

means defining a cutout window in said first panel adjacent said second edge and said first fold line;

means defining an outgoing address area on said second face of said second panel aligned with said window so that when said first and second panels are folded about said first fold line so that the second faces thereof are in face-to-face engagement, said outgoing address area is visible through said window;

means defining an outgoing return address area on said first face of said first panel adjacent said first and top edges of said sheet;

a first line of weakness extending through said second and third panels parallel to said side edges defining first and second subpanels in each, said first subpanel in each being defined by said first side edge and said first line of weakness and said second subpanel in each being defined by said first line of weakness and said second side edge, said second panel second subpanel second face having said outgoing address area thereon;

means defining a reply address area on said second face of said second panel first subpanel;

first permanent adhesive patterns provided on at least one of said second and third panel first subpanel first faces for defining said second and third panel first subpanels into a reply envelope having permanent adhesive on first through third sides thereof when said second and third panels are folded about said second fold line so that said first faces thereof are in face-to-face engagement;

a reply envelope closing flap formed in one of said second and third panel first subpanel and having activatable adhesive thereon for sealing a reply envelope on a fourth side thereof;

second, third, fourth, fifth and sixth lines of weakness formed in said first, second and third panels parallel to said top and bottom edges, and first through third panels parallel to and spaced from each of said first and second side edges, defining tear-off strips providing for ready opening of a mailer constructed by Z-folding said sheet about said fold lines; and second permanent adhesive patterns provided in at least some of said tear-off strips for holding said first through third panels together in an outgoing mailer when said sheet is Z-folded about said fold lines.

2. An intermediate as recited in claim 1 wherein said first line of weakness does not extend into said first panel, and does not intersect said window.

3. An intermediate as recited in claim 2 wherein said reply envelope flap extends parallel to said first and second side edges, and is bordered by said first line of weakness, so that the reply envelope constructed from said second and third panels is a side opening envelope.

4. An intermediate as recited in claim 3 wherein said reply envelope flap is formed in said second panel, and wherein said first permanent adhesive patterns are heat seal adhesive strips provided on said third panel first face.

5. An intermediate as recited in claim 2 wherein said reply envelope flap extends parallel to said top and bottom edges, and is bordered by said third line of weakness, so that the reply envelope constructed from said second and third panels is a top opening envelope.

6. An intermediate as recited in claim 5 wherein said reply envelope flap is formed in said second panel, and wherein said first permanent adhesive patterns are heat seal adhesive strips provided on said third panel first face.

7. An intermediate as recited in claim 1 wherein the longest dimension of the interior of the reply envelope formed from said intermediate is at least about six inches, so that the reply envelope can receive an unfolded bank check therein.

8. An intermediate as recited in claim 1 wherein said second permanent adhesive patterns comprises a strip of heat seal adhesive provided on said third panel second subpanel first face adjacent said bottom edge, for sealing said second and third panel second subpanels together along one edge thereof when said sheet is Z-folded about said second fold line.

9. An intermediate as recited in claim 1 wherein said second and third panel second subpanels are devoid of adhesive patterns extending parallel to said top and bottom edges, so that when said sheet is Z-folded about said second fold line said second and third panel second subpanels space between said second and third panel second subpanels is accessible from said bottom edge.

10. An intermediate as recited in claim 1 wherein said fold lines are lines of weakness, and wherein said activatable adhesive is rewettable adhesive, and wherein said permanent adhesive comprises heat seal or pressure seal adhesive.

11. An intermediate as recited in claim 1 further comprising security screening provided on said first face of said second and third panel first subpanels.

12. A mailer type business form, comprising:

first, second, and third substantially equal size quadrate plies, said second ply sandwiched between said first and third plies, and each ply having a top face and a bottom face;

lines of weakness formed in said second and third plies defining said second and third plies into first and second subplies, said first subplies larger than said second subplies;

a window in said first ply overlying said second subply of said second panel;

an outgoing address provided on said second ply second subply top face, aligned with and visible through said window;

an outgoing return address provided on said first ply top face remote from said window, and overlying said first subplies of said second and third plies;

a reply address provided on said top face of said second ply first subply;

first permanent adhesive patterns acting between said second ply first subply bottom face and said third ply first subply top face for holding said second and third ply first subplies together along first through third edges of each to form a reply envelope;

a reply envelope flap formed in one of said second and third plies first subply along a fourth edge of a reply envelope, and including activatable adhesive on a face thereof which is interior of said mailer;

additional lines of weakness formed adjacent edges of said first through third plies to define tear-off strips for providing ready opening of said mailer; and second permanent adhesive patterns provided on said tear-off strips for holding said first through third plies together to form said mailer until said tear-off strips are removed.

13. A mailer as recited in claim 12 wherein said first line of weakness does not extend into said first ply, and does not intersect said window.

14. A mailer as recited in claim 13 wherein each of said plies has top, bottom, and two side edges, said top and bottom edges being longer than said side edges; and wherein said reply envelope flap extends parallel to said side edges and is bordered by said first line of weakness so that said reply envelope is a side opening envelope.

15. A mailer as recited in claim 14 wherein said reply envelope flap is formed in said second ply, with said activatable adhesive provided on a strip on said second ply bottom face, and wherein said first permanent adhesive patterns are heat sealable adhesive strips provided on said third ply top face and adhesively connected to said second ply bottom face.

16. A mailer as recited in claim 13 wherein each of said plies has top, bottom, and two side edges, said top and bottom edges being longer than said side edges; and wherein said reply envelope flap extends parallel to said top and bottom edges, so that said reply envelope is a top opening envelope.

17. A mailer as recited in claim 16 wherein said reply envelope flap is formed in said second ply, with said activatable adhesive provided on a strip on said second ply bottom face, and wherein said first permanent adhesive patterns are heat sealable adhesive strips provided on said third ply top face and adhesively connected to said second ply bottom face.

18. A mailer as recited in claim 12 further comprising security screening provided on said second ply first subply bottom face and third ply first subply top face.

19. A mailer as recited in claim 12 wherein the longest dimension of the interior of said reply envelope is at least about six inches, so that said reply envelope can receive an unfolded bank check therein.

20. A mailer as recited in claim 12 further comprising imaged indicia substantially completely covering said bottom face of said first ply, said bottom face of said second ply second subply, and said top face of said third ply second subply.

* * * * *